US005416269A

United States Patent [19]

Kemp et al.

[11] Patent Number: 5,416,269

[45] Date of Patent: May 16, 1995

[54] INSULATED CABLE AND METHOD OF MAKING SAME

[75] Inventors: John L. Kemp, Menlo Park; Alan S. Yeung, Redwood City, both of Calif.

[73] Assignee: Raychem Corporation, Menlo Park, Calif.

[21] Appl. No.: 146,568

[22] Filed: Nov. 1, 1993

[51] Int. Cl.[6] ..... H01B 7/34

[52] U.S. Cl. ..... 174/36; 174/107; 174/110 PM; 174/113 R; 174/115; 174/110 FC

[58] Field of Search ..... 174/110 R, 110 FC, 110 PM, 174/36, 107, 115, 113 R

[56] References Cited

U.S. PATENT DOCUMENTS

| | | | |
|---|---|---|---|
| 3,793,716 | 2/1974 | Smith-Johannsen | 29/611 |
| 3,829,603 | 8/1974 | Hansen et al. | 174/115 |
| 3,923,439 | 12/1975 | Isley et al. | 425/150 |
| 3,993,860 | 11/1976 | Snow et al. | 174/69 |
| 4,041,237 | 8/1977 | Stine et al. | 174/36 |
| 4,096,346 | 6/1978 | Stine et al. | 174/36 |
| 4,366,464 | 12/1982 | Miyamoto et al. | 338/214 |
| 4,374,299 | 2/1983 | Kincaid | 174/36 |
| 4,461,923 | 7/1984 | Bogese, II | 174/36 |
| 4,467,138 | 8/1984 | Brorein | 174/115 |
| 4,469,539 | 9/1984 | Wade et al. | 156/51 |
| 4,510,346 | 4/1985 | Bursh, Jr. et al. | 174/36 |
| 4,532,375 | 7/1985 | Weitzel et al. | 174/107 |
| 4,677,418 | 6/1987 | Shulver | 338/214 |
| 4,678,709 | 7/1987 | Tondre et al. | 428/380 |
| 4,751,031 | 6/1988 | Baars | 264/35 |
| 4,851,060 | 7/1989 | Wade, Jr. et al. | 156/53 |
| 4,873,393 | 10/1989 | Friesen et al. | 174/34 |
| 4,956,523 | 9/1990 | Pawluk | 174/107 |
| 5,038,002 | 8/1991 | Viaud | 174/115 |
| 5,106,686 | 4/1992 | Wade, Jr. et al. | 428/377 |
| 5,107,076 | 4/1992 | Bullock et al. | 174/107 |
| 5,144,098 | 9/1992 | VanDeusen | 174/36 |
| 5,218,167 | 6/1993 | Grasque, Jr. | 174/115 |

OTHER PUBLICATIONS

Raychem Trade Brochure entitled "Thermorad F ASB", published Sep. 1993.

*Primary Examiner*—Morris H. Nimmo
*Attorney, Agent, or Firm*—Timothy H. P. Richardson; Herbert G. Burkard

[57] ABSTRACT

An insulated cable which combines good roundness and good strippability includes one or more insulated conductors, an inner lining of polymeric tape wrapped around the conductors, and an outer jacket of polymeric insulation melt extruded around the inner lining. The level of adhesion between the inner lining and the conductors is less than the level of adhesion between the inner lining and the outer jacket. The insulated cable is particularly useful in anti-lock braking systems. A process for making the cable is also disclosed.

19 Claims, 1 Drawing Sheet

INSULATED CABLE AND METHOD OF MAKING SAME

FIELD OF THE INVENTION

This invention relates to insulated cables, i.e., cables in which an outer insulating jacket surrounds two or more conductors, at least one of the conductors being surrounded by a layer of insulation.

BACKGROUND OF THE INVENTION

Many insulated cables must meet requirements for strippability and roundness. Strippability (i.e., the ability to remove the jacket without damaging the conductors and insulation within the jacket) is particularly important when the cable is stripped by automatic machinery. Roundness is particularly important when a mold must be fitted around the cable as part of a process in which a terminal is formed on the end of the cable (sometimes referred to as "overmolding" and when the cable must pass through a precisely sized port, for example, prior to being sealed to the port. Roundness is usually expressed as a number obtained by dividing the minimum diameter by the maximum diameter and multiplying by 100. One example of a cable which must be both round and strippable is the twisted pair cable which is used in anti-lock braking systems (ABS) to connect the wheel speed sensors and the electronic controller; such an ABS cable preferably has a roundness of at least 96%.

It is not easy to make a cable which contains a small number of individual conductors (particularly a twisted pair of insulated conductors) and which is both round and strippable. A cable having good strippability can be made by a tube extrusion process, but the product has poor roundness. A cable having good roundness can be obtained by pressure-extruding a polymeric composition around two or more individually insulated conductors (and optionally filler rods of insulating material), but the jacket material tends to fill the interstices between the insulated conductors, making the jacket difficult to strip. The conventional solution to this problem is to apply talc powder or other release agent to the insulated conductors before applying the jacket. However, this does not prevent the jacket material from filling the interstices between the insulated conductors and is undesirable because of environmental concerns and potentially adverse effects of the release agent.

When an insulating jacket has been prepared by extrusion around a large cable, it often suffers from a problem referred to as "shrinkback", i.e. after an end portion of the jacket has been cut off in order to remove the jacket at a termination, the remaining jacket shrinks back from the termination. The tendency of a cable to shrink back can be assessed by cutting a short length of the cable, e.g. a 12 inch length, and maintaining it in an oven at an elevated temperature, e.g. 150° C., for an extended time, e.g. 6 hours, and measuring the shrinkage of the jacket.

A shielded cable typically contains a metal braid or a wrapped metal foil which provides a continuous conductive shield over the insulated conductors. A cable with metal braid is difficult to strip because the braid is difficult to cut. Metal foil, when wrapped directly over the insulated conductors, is difficult to strip without damage to the insulated conductors, because it conforms to the shape of the insulated conductors as it is wrapped.

SUMMARY OF THE INVENTION

We have discovered that a cable having excellent strippability can be made by wrapping an inner lining of a polymeric tape around insulated and/or non-insulated conductors before applying an outer insulating jacket, and bonding the wrapped tape to the jacket. Use of such an inner lining is particularly valuable when the jacket is pressure-extruded since the cable can then have not only excellent strippability, but also excellent roundness (or other desired external shape determined by the extrusion die). It is also particularly valuable for cables containing 2, 3 or 4 insulated conductors twisted together without filler rods.

We have also discovered that by wrapping the conductors with a tape which is a laminate of an insulating polymer layer and an adherent metallic layer, it is possible to make a shielded cable which can be easily stripped, even by automatic machinery. For this purpose, the laminate can be, for example, one of the metallized polymeric tapes which are readily available. Because the longitudinal resistance of a shielding layer produced in this way may be high, the cable preferably includes a non-insulated conductor which makes at least intermittent contact with the shielding layer, thus providing a drain wire. Preferably the laminate is wrapped directly around the insulated and/or non-insulated conductors, with the metallic layer on the inside, and then covered by an insulating jacket. Generally, the insulating jacket is extruded, preferably pressure extruded, around the wrapped laminate.

In a first preferred aspect, this invention provides an insulated cable which comprises:

(a) two or more conductors;

an inner lining of polymeric insulation which surrounds said two or more conductors collectively, and which comprises a polymeric tape wrapped around the conductors; and (c) an outer jacket of polymeric insulation comprising a polymeric composition which has been melt-extruded around the inner lining;

the level of adhesion between the conductors and the inner lining being less than the level of adhesion between the inner lining and the outer jacket.

A particularly valuable embodiment of this aspect of the invention is an insulated cable which has a roundness of at least 90%, preferably at least 96%, and which comprises (a) two insulated metallic conductors which are twisted together and each of which is surrounded by a first layer of polymeric insulation;

(b) an inner lining of polymeric insulation which (i) surrounds but is not bonded to the insulated conductors, and (ii) comprises a polymeric tape wrapped around the conductors; and (c) an outer jacket of polymeric insulation which (i) comprises a polymeric composition which has been pressure-extruded around the inner lining and (ii) is bonded to the inner lining.

In a second preferred aspect, this invention provides an assembly which is suitable, for example, for connecting a wheel speed sensor to an electronic controller in an antilock braking system and which comprises (1) a cable which preferably has a roundness of at least 96% and which comprises (a) two insulated metallic conductors which are twisted together and each of which is surrounded by a first layer of polymeric insulation;

(b) an inner lining of polymeric insulation which (i) surrounds but is not bonded to the insulated conductors, and (ii) comprises a polymeric tape wrapped around the conductors; and (c) an outer jacket of polymeric insulation which (i) comprises a polymeric composition which has been pressure-extruded around the inner lining and (ii) is bonded to the inner lining; and said cable having a terminal portion in which (i) the outer jacket and the inner lining have been removed to expose end portions of the insulated conductors, (ii) the first layer of insulation has been removed from part of each of the exposed end portions, (2) two terminals which are individually connected to the exposed end portions of the conductors; and (3) a molded body of an insulating polymeric composition which is molded around the terminal portion of the cable and the terminals and thus provides a water-impermeable seal around the terminal portion of the cable, the electrical connections between the cable and the sensor, and at least a part of each of the terminals.

In a third preferred aspect, this invention provides a process for making an insulated cable which comprises:

(1) providing two or more conductors;

(2) wrapping a polymeric tape around the conductors; and (3) melt-extruding a polymeric composition around the polymeric tape to form an outer jacket, the composition being extruded at a temperature such that the outer jacket becomes melt-bonded to the polymeric tape.

DETAILED DESCRIPTION OF THE INVENTION

Figure 1:
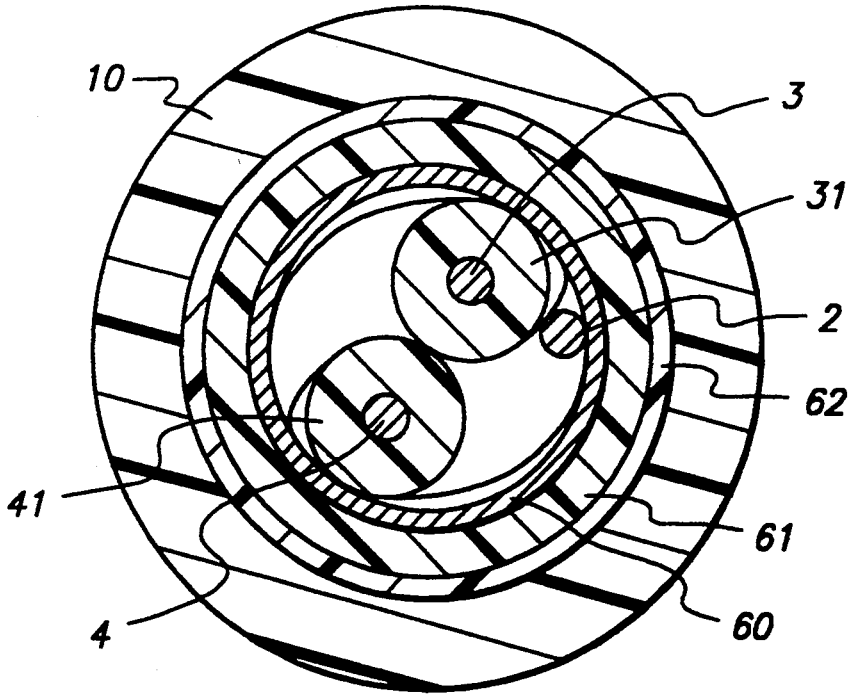
FIG. 1 is a diagrammatic cross section through a cable of the invention.

In order to strip the outer jacket from small cables, high speed, automatic cutting and stripping equipment is preferably employed. Small cables may be employed in a variety of applications, with any number of individual conductors, for example to connect a wheel speed sensor to an electronic controller in an anti-lock brake system (ABS). In some of these applications, it is desirable that the cable also provides shielding for the individual conductors, e.g. from EMI and/or RF radiation. The present invention is particularly useful for cables which must be stripped automatically and/or must contain shielding.

The term "conductor" is used herein to include metallic conductors and optical fibers. When the conductor is metallic, at least one of the conductors is individually surrounded by a first layer of insulation. The conductor can be a solid or a stranded wire composed of a single metal or a first metal coated by a second metal. Suitable metals include tin, copper, silver, and nickel, and combinations thereof. An inner layer of polymeric insulation may be provided around one or more of the individual conductors; in many cases all the conductors are insulated or all but one of the conductors are insulated, with the uninsulated conductor being a drain wire. The insulation may be crosslinked (by radiation or otherwise) or uncrosslinked. Suitable insulating materials include PVC, ethylene/tetrafluoroethylene (ETFE) copolymers (including terpolymers), and other fluoropolymers. The insulating material preferably has a melting point higher than the melting point of at least the outer surface of the polymeric, tape, so that the outer surface of the tape can be melt bonded to the outer jacket at a temperature which does not affect the inner layer of insulation. The thickness of the inner layer of insulation may be for example 0.002 to 0.05 inch, preferably 0.004 to 0.03 inch.

In order to provide the inner lining, a polymeric tape is wrapped around the conductors. The tape may be for example 0.0007 to 0.01 inch thick. Preferably, the tape is wrapped longitudinally, but it may also be wrapped helically, or in some other manner. The polymeric tape may be composed of any suitable material, e.g. a polyester, and may comprise one or more layers of the same or different polymers. Especially when a shielded cable is needed, the tape can comprise a metallized layer which forms the interior of the wrapped tape. The outer surface of the wrapped tape is preferably such that it becomes melt-bonded to the outer jacket as the jacket is being melt extruded. This can conveniently be achieved by means of a layer of hot melt adhesive which is present on the tape before it is wrapped, or which is applied to the tape after it has been wrapped. The adhesive layer can be for example 0.0001 to 0.001 inch thick. The inner surface of the tape is preferably smooth and slick so that it can be easily stripped from the conductors. It is also possible, but not preferred, for a release agent or the like to be present at the interface between the tape and the conductor. Such a release agent can be applied to the surface of the tape and/or the conductors before or during the wrapping operation.

The outer jacket insulation is formed by melt extrusion, preferably by pressure extrusion, of a suitable polymeric composition, e.g. a composition comprising PVC, a polyolefin, a silicone rubber, a nitrile rubber, a polyester or a fluoropolymer. The thickness of the jacket can be for example 0.004 to 0.07 inch, preferably 0.005 to 0.03 inch. After it has been extruded, the jacket can if desired be crosslinked. The roundness of the finished cable is preferably at least 85%, particularly at least 90%, especially at least 96%. The unrelieved stresses in the jacket are preferably such that the jacket shrinks by less than 2% when a length thereof, e.g. a 12 inch length, is maintained at 150° C. for 6 hours.

Referring now to the drawings, FIG. 1 is a diagrammatic cross section through a cable of the invention. The cable includes an uninsulated conductor 2, and conductors 3,4 which are surrounded by layers 31,41 respectively of polymeric insulation. Wrapped around these conductors is a tape which comprises an outer layer 62 of a hot melt adhesive, a central layer 61 of a polymeric composition having a melting point substantially higher than the adhesive, and an inner layer 60 which is composed of a metal. The wrapped tape is surrounded by an outer insulating jacket 10 which comprises a polymeric composition which has been melt-extruded around the wrapped tape at a temperature above the melting point of the adhesive layer 62, so that, after cooling, the jacket is melt bonded to insulating layer 61.

Figure 2:
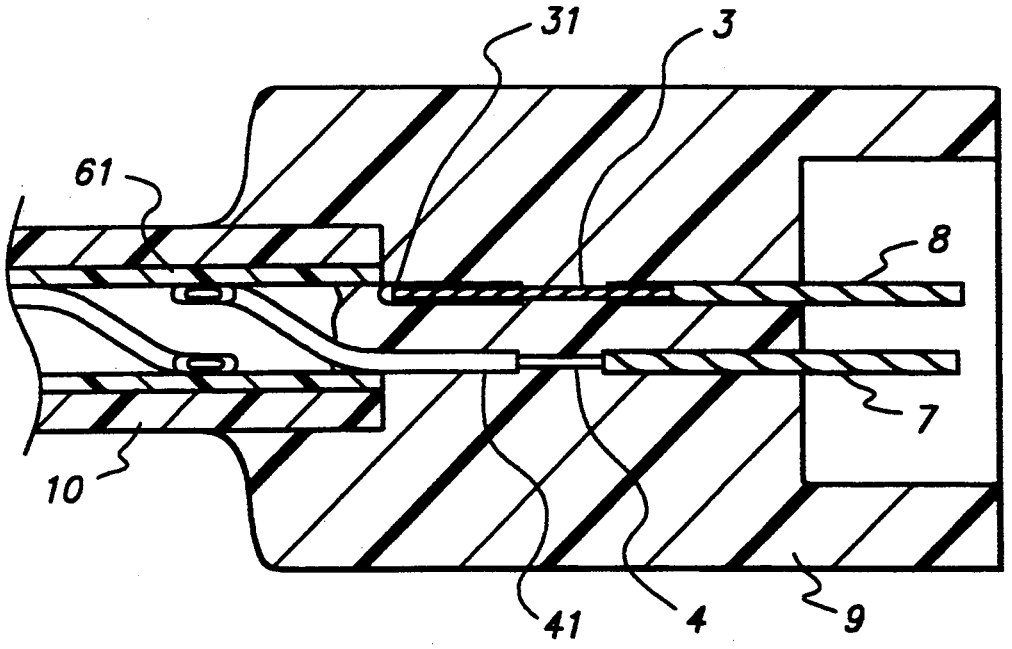
FIG. 2 is a diagrammatic cross section through an assembly which is suitable for connecting a wheel speed sensor to an electronic controller in an ABS system and which includes a cable of the invention.

FIG. 2 is a diagrammatic cross section through one end of a cable of the invention which has terminated so as to be useful, for example, in an ABS system. As in FIG. 1, the cable comprises a twisted pair of insulated conductors (3 and 31, 4 and 41), surrounded in turn by a wrapped polymeric tape 61 and an outer jacket 10. The end of the jacket 10 has been stripped to expose end portions of the insulated conductors, from which the insulation 31,41 has been removed. The exposed conductors have been crimped to terminals 7,8, and the assembly has been sealed by means of a molded body 9 of an insulating polymeric composition. The roundness of the cable is critical in the overmolding used to make the molded body 9, since the mold must fit closely around the cable.

The invention is illustrated by the following Examples.

EXAMPLE 1

A cable according to the invention was prepared as follows. Two insulated wires were twisted together on a twinner, with a nominal lay of 1.13 inch. Each wire was a 22 AWG stranded tin-coated copper conductor (diameter 0.031 inch) covered by a layer about 0.006 inch thick of radiation crosslinked ethylene/tetrafluoroethylene copolymer. Such wire is sold by Raychem Corp. under the trade name Spec 55®. The twisted pair was then longitudinally wrapped by a tape having a width of about 0.75 inch and a thickness of about 1.12 mil. The tape consisted of a polyester layer about 0.0092 inch thick and a layer of hot melt adhesive about 0.0002 inch thick, and is available from Neptco, Inc. under the trade name NEPTAPE® 6110. The tape was wrapped so that the adhesive layer was on the outside. A crosslinkable polyolefin material was pressure extruded around the wrapped conductors, using a 2.5 inch extruder, to give a cable having a nominal outer diameter of 0.153 inch. The polyolefin was extruded at a temperature of about 190° C., which is above the melting point of the adhesive layer on the tape, thus causing the jacket and the tape to be melt-bonded to each other. The crosslinkable polyolefin material was a mixture of low density polyethylene and an ethylene/vinyl acetate copolymer. The cable jacket was then crosslinked by radiation on a 1.5 MeV electron beam at a dosage of 10–30 MRAD. The finished cable could be easily and cleanly stripped.

EXAMPLE 2

A cable was prepared in the same was as in Example 1 except that the polyester tape was not wrapped around the conductors. The resulting cable was much more difficult to strip than the cable prepared in Example 1.

EXAMPLE 3

A cable could be prepared as in Example 1 except that the tape included an inner metallized layer and the conductors around which the tape was wrapped included an uninsulated drain wire.

What is claimed is:

1. An insulated cable which comprises:
   (a) two or more conductors, at least two of said conductors being a metallic conductor which is individually surrounded by a first layer of polymeric insulation;
   (b) an inner lining of polymeric insulation which surrounds said two or more conductors collectively, and which comprises a polymeric tape wrapped around the conductors; and
   (c) an outer jacket of polymeric insulation comprising a polymeric composition which has been melt-extruded around the inner lining;

the level of adhesion between the conductors and the inner lining being less than the level of adhesion between the inner lining and the outer jacket.

2. A cable according to claim 1 wherein the outer jacket has been pressure extruded.

3. A cable according to claim 1 wherein the inner lining is melt-bonded to the outer jacket.

4. A cable according to claim 3 wherein there is a layer of hot melt adhesive which bonds the inner lining to the outer jacket.

5. A cable according to claim 1 wherein the melting point of the first layer of insulation is higher than the melting point of at least the outer surface of the polymeric tape.

6. A cable according to claim 1 wherein the first layer comprises an ethylene/tetrafluoroethylene copolymer.

7. A cable according to claim 1 which contains a total of two, three or four individually insulated conductors which are twisted together.

8. A cable according to claim 1 wherein the polymeric tape is a polyester tape.

9. A cable according to claim 1 which further comprises
   (d) a metallic layer which is bonded to the polymeric tape and which provides a substantially continuous shield over the conductors.

10. A cable according to claim 9 wherein one of said conductors is an uninsulated drain wire which makes electrical contact with the metallic layer.

11. A cable according to claim 1 wherein the outer jacket has a roundness of at least about 90%.

12. A cable according to claim 1 wherein the outer jacket contains thermal stresses such that the jacket shrinks by less than 2% when a 12 inch length of the cable is maintained at 150° C. for 6 hours.

13. A cable according to claim 1 wherein the conductors are optical fibers.

14. An insulated cable which has a roundness of at least 96% and which comprises
   (a) two insulated metallic conductors which are twisted together and each of which is surrounded by a first layer of polymeric insulation;
   (b) an inner lining of polymeric insulation which (i) surrounds but is not bonded to the insulated conductors, and (ii) comprises a polymeric tape wrapped around the conductors; and
   (c) an outer jacket of polymeric insulation which (i) comprises a polymeric composition which has been pressure-extruded around the inner lining and (ii) is bonded to the inner lining.

15. A cable according to claim 14 wherein the first layer of insulation comprises an ethylene/tetrafluoroethylene copolymer; the inner lining comprises a polyester tape and a layer of an adhesive which is melt-bonded to the outer jacket; and the outer jacket comprises a polyolefin.

16. A cable according to claim 15 wherein the first layer of insulation and the outer jacket have been crosslinked by radiation.

17. An assembly which comprises
   (1) a cable which has a roundness of at least 90% and which comprises (a) two insulated metallic conductors which are twisted together and each of which is surrounded by a first layer of polymeric insulation;

(b) an inner lining of polymeric insulation which (i) surrounds but is not bonded to the insulated conductors, and (ii) comprises a polymeric tape wrapped around the conductors; and (c) an outer jacket of polymeric insulation which (i) comprises a polymeric composition which has been pressure-extruded around the inner lining and (ii) is bonded to the inner lining; and said cable having a terminal portion in which (i) the outer jacket and the inner lining have been removed to expose end portions of the insulated conductors, (ii) the first layer of insulation has been removed from part of each of the exposed end portions, (2) two terminals which are individually connected to the exposed end portions of the conductors; and (3) a molded body of an insulating polymeric composition which is molded around the terminal portion of the cable and the terminals and thus provides a water-impermeable seal around the terminal portion of the cable, the electrical connections between the cable and the sensor, and at least a part of each of the terminals.

18. An assembly according to claim 17 wherein the cable has a roundness of at least 96%.

19. A process for making an insulated cable which comprises:

(1) providing two or more conductors, at least two of the conductors being a metallic conductor which is individually surrounded by a first layer of polymeric insulation;

(2) wrapping a polymeric tape around the conductors; and (3) melt-extruding a polymeric composition around the polymeric tape to form an outer jacket, the composition being extruded at a temperature such that the outer jacket becomes melt-bonded to the polymeric tape.

* * * * *

UNITED STATES PATENT AND TRADEMARK OFFICE

CERTIFICATE OF CORRECTION

PATENT NO. : 5,416,269
DATED : May 16, 1995
INVENTOR(S) : John L. Kemp, et al.

It is certified that error appears in the above-indentified patent and that said Letters Patent is hereby corrected as shown below:

Column 2, Line 38, before "an inner lining", please insert --(b)--.
Column 4, Line 10, please replace "polymeric," by --polymeric--.

Signed and Sealed this

Tenth Day of October, 1995

*Attest:*

*Attesting Officer*

BRUCE LEHMAN

*Commissioner of Patents and Trademarks*